US006945437B2

(12) United States Patent
Ozawa et al.

(10) Patent No.: US 6,945,437 B2
(45) Date of Patent: Sep. 20, 2005

(54) SIPHON TUBE OF CONNECTOR ADAPTED TO BE MOUNTED ON RESERVOIR

(75) Inventors: Toshihiko Ozawa, Saitama (JP); Takashi Imai, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 121 days.

(21) Appl. No.: 10/245,592

(22) Filed: Sep. 18, 2002

(65) Prior Publication Data

US 2003/0071459 A1 Apr. 17, 2003

(30) Foreign Application Priority Data

Sep. 18, 2001 (JP) ..... 2001-283565

(51) Int. Cl.[7] ..... B67D 5/60

(52) U.S. Cl. ..... 222/464.1; 222/464.4; 222/189.1

(58) Field of Search ..... 222/464.1, 464.3–464.4, 222/464.6, 189.1

(56) References Cited

U.S. PATENT DOCUMENTS

| | | | | | |
|---|---|---|---|---|---|
| 252,519 | A | * | 1/1882 | Griffith et al. | 222/450 |
| 820,371 | A | * | 5/1906 | Skinner | 74/149 |
| 3,178,081 | A | * | 4/1965 | Adams | 222/456 |
| 3,980,210 | A | * | 9/1976 | Kligerman | 222/456 |
| 4,286,735 | A | * | 9/1981 | Sneider | 222/211 |
| 4,634,028 | A | * | 1/1987 | de Larosiere | 222/464.2 |
| 5,071,041 | A | * | 12/1991 | Garbe | 222/405 |
| 5,381,961 | A | * | 1/1995 | Evans et al. | 239/333 |
| 5,611,467 | A | * | 3/1997 | Peng | 222/464.4 |
| 5,842,076 | A | * | 11/1998 | Glover et al. | 396/626 |
| 5,957,328 | A | * | 9/1999 | Osgar | 222/1 |
| 5,971,019 | A | * | 10/1999 | Imai | 137/614.04 |
| 6,027,041 | A | * | 2/2000 | Evans | 239/334 |
| 6,202,943 | B1 | * | 3/2001 | Evans et al. | 239/333 |
| 6,375,092 | B1 | * | 4/2002 | Banach | 239/33 |

FOREIGN PATENT DOCUMENTS

| | | | | |
|---|---|---|---|---|
| CH | 677197 | A * | 4/1991 | B05B/1/02 |
| EP | 0340940 | A * | 11/1989 | B65D/47/06 |
| JP | 11-193894 | | 7/1999 | |

* cited by examiner

*Primary Examiner*—Frederick Nicolas
(74) *Attorney, Agent, or Firm*—Browdy and Neimark, PLLC

(57) ABSTRACT

In a siphon tube (1) of a reservoir, even when a front end of tube (1) is in the vicinity of the bottom of the reservoir, there is no fear that slurries are sucked by tube (1) which: reaches the bottom of the reservoir to draw a liquid contained therein out of the reservoir is characterized by a liquid-inlet opening (3) directed normal to a longitudinal axis of tube (1). Tube (1) has its front end formed into: an inverted T-shape provided with opposite end openings in a laterally extending portion thereof, each of which openings forms the liquid-inlet opening (3); or, an L-shaped curved form a front end of which forms an opening directed normal to the longitudinal axis of tube (1); or, is closed with a cap so that an opening is disposed adjacent to an upper surface of the cap to serve as the liquid-inlet opening.

6 Claims, 5 Drawing Sheets

FIG. 5 *(PRIOR ART)*
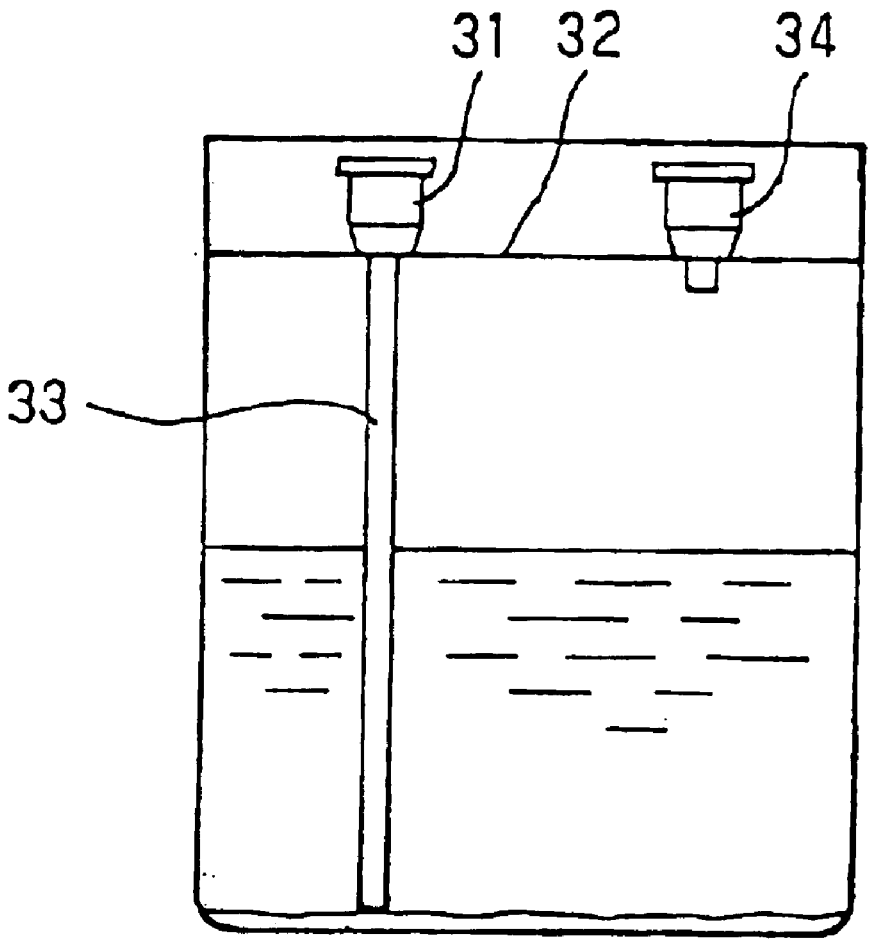

SIPHON TUBE OF CONNECTOR ADAPTED TO BE MOUNTED ON RESERVOIR

BACKGROUND OF THE INVENTION

1. Field of the Invention

The present invention relates to a siphon tube of a connector adapted to be mounted on a reservoir, and more particularly to a siphon tube of a connector adapted to be mounted on a reservoir, wherein the connector is fixedly mounted on a lid of a liquid reservoir and adapted to be detachably connected with an outside hose for supplying a liquid contained in the reservoir to the outside facilities through both the siphon tube and the outside hose, wherein the liquid comprises various types of industrial chemical agents used in a semiconductor fabrication process, various types of paints, various types of medicines and like liquids.

2. Description of the Related Art

As for a conventional connector adapted to be mounted on a reservoir, the prior art, for example such as Japanese Patent Application Laid-Open No. Hei 11-193894 describes various types of conventional connectors. Of these conventional connectors: a first one uses a valve which is contained in a plug and adapted to be opened when kinetically pushed to permit the liquid to pass through the thus opened valve, wherein a siphon tube is mounted on the valve; and, although a second one is not provided with any valve, it is provided with a siphon tube and has such a siphon tube directed mounted on a plug.

As shown in FIG. 5, a connector 31 adapted to be mounted on a reservoir is fixedly mounted on a lid 32 of the reservoir in a condition in which a lower end portion of a siphon tube 33 reaches the bottom of the reservoir. Further, a connecting opening 34, which is adapted to be connected with a coupling member for supplying a pressurized gas to the interior of the reservoir, is also fixedly mounted on the lid 32 of the reservoir. When the pressurized gas is supplied to the interior of the reservoir through the connecting opening 34, a liquid surface inside the reservoir is pneumatically pressed downward, so that a level of the liquid inside the siphon increases in height to reach the connector 31, whereby the liquid contained in the reservoir passes through the connector 31 to flow out of the reservoir and enter the outside hose.

On the other hand, in the prior art, a lower end portion of the siphon tube 33 is cut off at right angles to have its circular opening directly directed to the bottom of the reservoir, or obliquely cut off to have its oval opening obliquely directed relative to the bottom of the reservoir. In the prior art, in order to draw the liquid out of the reservoir as much as possible, the siphon tube 33 has its front end opening abut against the bottom of the reservoir or disposed in the vicinity of the bottom of the reservoir.

As described above, when the siphon tube 33 has its lower end portion disposed in the vicinity of the bottom of the reservoir, there is a fear that slurries having been deposited on the bottom of the reservoir are sucked by the siphon tube 33 together with the liquid when the liquid is drawn out of the reservoir. Due to this, the siphon tube 33, connector 31 and like tubes or hoses tend to be clogged with the thus sucked slurries. Further, the slurries thus sucked and transferred to the outside facilities adversely affect any subsequent treatment conducted in the outside facilities in which the liquid containing the slurries is used.

SUMMARY OF THE INVENTION

Under such circumstances, the present invention was made to solve the problems inherent in the prior art.

Consequently, it is an object of the present invention to provide a siphon tube of a connector adapted to be mounted on a reservoir, wherein the siphon tube of the present invention is free from any fear that the siphon tube sucks the slurries of the bottom of the reservoir even when the siphon tube is disposed in the vicinity of the bottom of the reservoir.

In accordance with a first aspect of the present invention, the above object of the present invention is accomplished by providing:

In a siphon tube of a connector adapted to be mounted on a reservoir, wherein the connector supports the siphon tube and is mounted on a lid of the reservoir, and the siphon tube reaches the bottom of the reservoir to draw a liquid contained in the reservoir out of the reservoir, the improvement wherein: the siphon tube has its lower end portion provided with a liquid-inlet opening which is directed normal to a longitudinal axis of the siphon tube.

In the siphon tube of the present invention having the above construction, preferably: the lower end portion of the siphon tube assumes an inverted T-shaped form provided with opposite end openings in opposite ends of a laterally extending portion of the inverted T-shaped form; the opposite end openings are directed normal to the longitudinal axis of the siphon tube; and, each of the opposite end openings of the siphon tube forms the liquid-inlet opening. Or, preferably the lower end portion of the siphon tube is bent in a direction normal to the longitudinal axis of the siphon tube to form a laterally extending portion; a front end portion of the laterally extending portion of the siphon tube is provided with a front end opening directed normal to the longitudinal axis of the siphon tube; and, the front end opening of the siphon tube forms the liquid-inlet opening. Or, preferably the lower end portion of the siphon tube is closed with a closure or cap. And, at lease one opening is formed in a circumferential surface of the siphon tube in a manner such that the opening is disposed adjacent to an upper surface of the cap and serves as the liquid-inlet opening.

The present invention has the above construction. Consequently, in the connector of the present invention adapted to be mounted on the reservoir, since the liquid-inlet opening of the siphon tube is directed normal to the longitudinal axis of the siphon tube, there is substantially no fear that the slurries having been deposited on the bottom of the reservoir are sucked by the siphon tube through the liquid-inlet opening thereof. Furthermore, it is substantially possible for the siphon tube of the present invention to draw all the liquid contained in the reservoir out of the reservoir.

BRIEF DESCRIPTION OF THE DRAWINGS

The above and other objects, advantages and features of the present invention will be more apparent from the following description taken in conjunction with the accompanying drawings in which:

FIG. 5 is a diagram illustrating the conventional siphon tube in use.

DETAILED DESCRIPTION OF THE PREFERRED EMBODIMENTS

The best modes for carrying out the present invention will be described in detail using embodiments of the present invention with reference to the accompanying drawings.

First Embodiment

Figure 1:
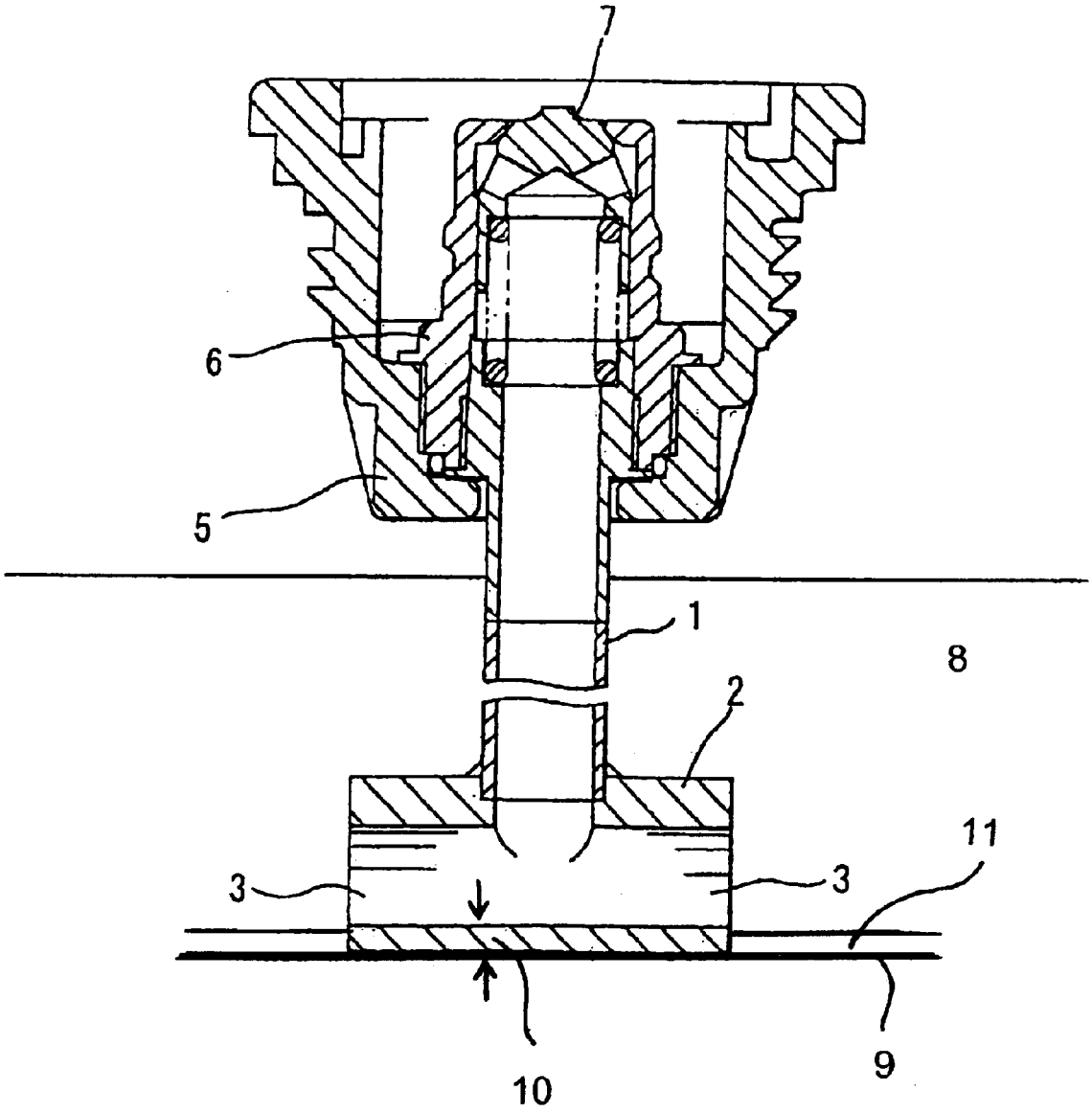
FIG. 1 is a longitudinal sectional view of a first embodiment of the siphon tube of the present invention.
Figure 2:
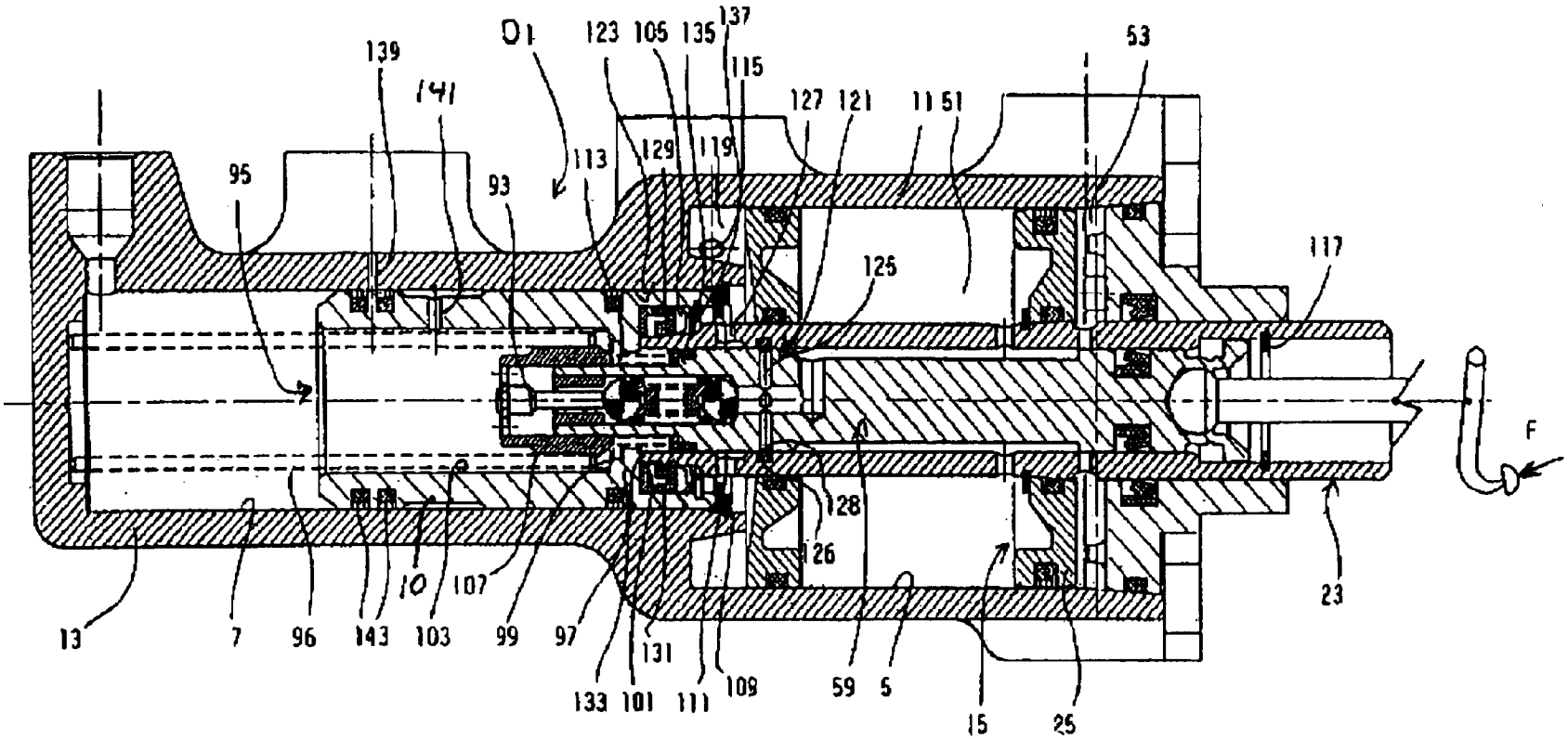
FIG. 2 is a side view of the siphon tube shown in FIG. 1.

FIGS. 1 and 2 show a first embodiment of a siphon tube 1 of the present invention. As shown in the drawings, an end portion 2 of the siphon tube 1 assumes an inverted T-shaped form provided with a laterally extending portion which reaches to the vicinity of the bottom or to the bottom of the reservoir as indicated above. The laterally extending portion of the siphon tube 1 is provided with opposite end openings in it opposite ends. Each of the opposite end openings of the end portion 2 serves as a liquid-inlet opening 3. In the first embodiment, the end portion 2 may be integrally formed with a main body of the siphon tube 1. As shown in FIG. 1, in the first embodiment, the end portion 2 and the main body of the siphon tubes 1 are separately formed and thereafter combined with each other using suitable fastening means to form the entire siphon tube 1. It is preferable to have the end portion 2 of the siphon tube 1 be larger in wall thickness than the main body of the siphon tube 1.

Incidentally, a connector, which is adapted to be mounted on a reservoir in which a liquid is contained, is constructed of: a plug guide 5; a plug 6 which is threadably connected with an inner surface of the plug guide 5; and, a valve 7 which is disposed inside the plug 6 to control the liquid in flow communication. Although the siphon tube 1 is fixedly mounted in the valve 7 in the first embodiment shown in FIG. 1, it is natural that various mounting types of the siphon tube 1 in the valve 7 may be employed in the connector in addition to the mounting type of the siphon tube 1 shown in FIG. 1.

Second Embodiment

Figure 3:
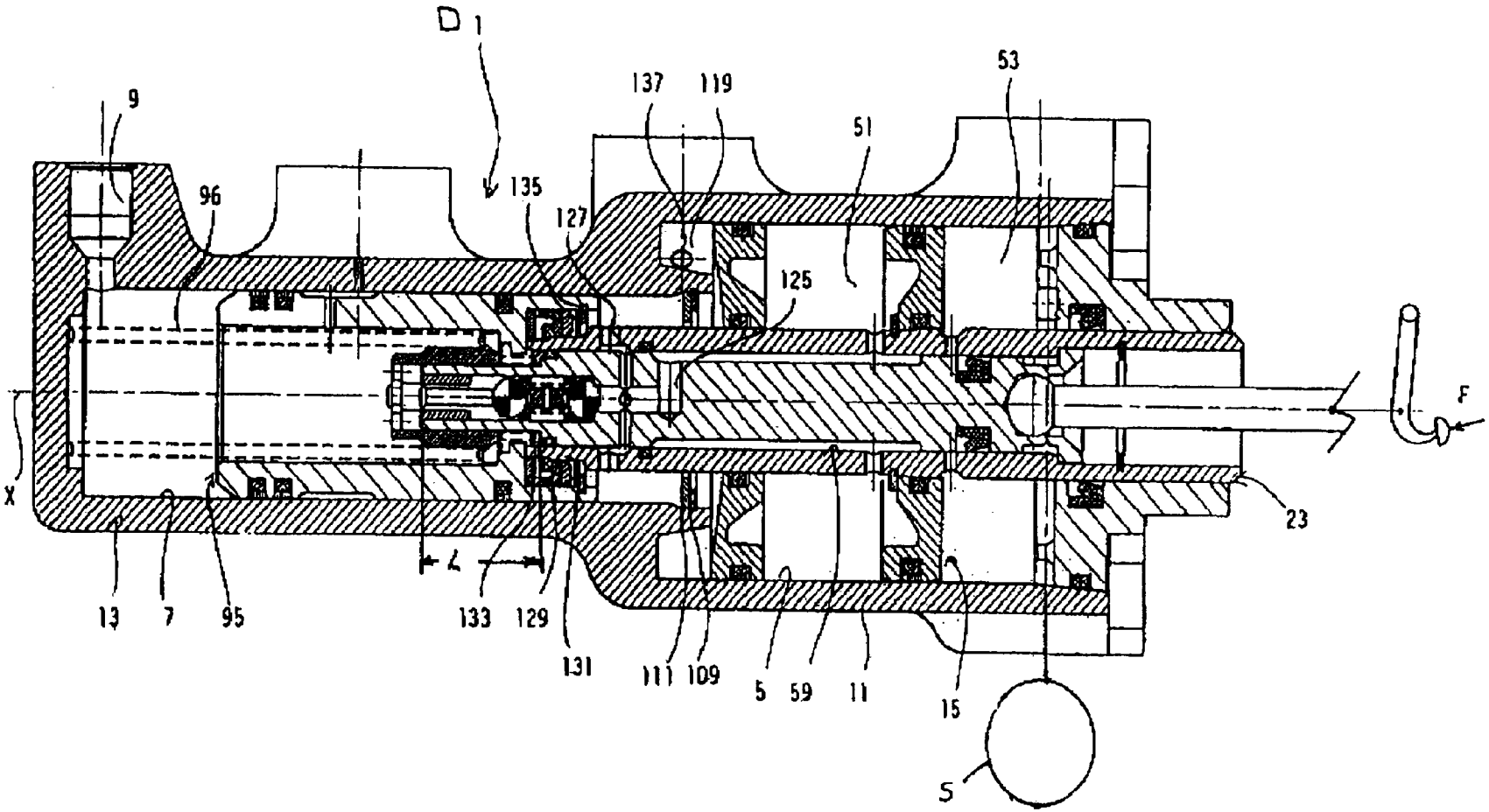
FIG. 3 is a partially broken sectional view of a second embodiment of the siphon tube of the present invention.

FIG. 3 shows a second embodiment of the end portion 2 of the siphon tube 1. In the second embodiment, the end portion 2 of the siphon tube 1 is bent to form a curved L-shaped portion provided with a laterally extending portion a front end portion of which forms the liquid-inlet opening 3 directed normal to the longitudinal axis of the siphon tube 1. In this embodiment, the laterally extending portion of the siphon tube 1 may abut against the bottom of the reservoir or may be disposed adjacent to the bottom of the reservoir, and may be large in wall thickness (see the phantom lines shown in FIG. 3).

Third Embodiment

Figure 4:
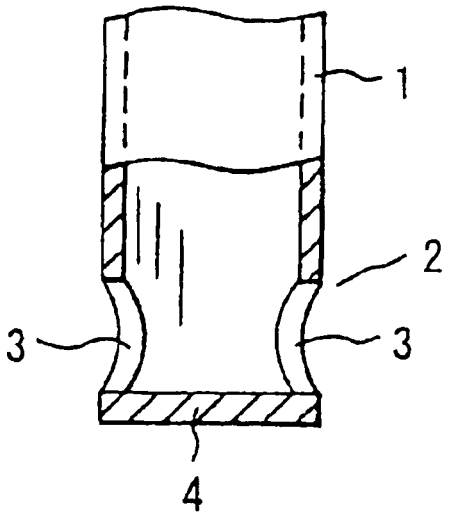
FIG. 4(A) is a partially sectional front view of a third embodiment of the siphon tube of the present invention.
FIG. 4(B) is a side view of the third embodiment of the siphon tube of the present invention.
Figure 4:
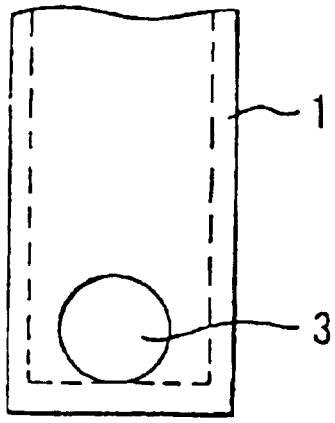

FIGS. 4(A) and 4(B) show a third embodiment of the siphon tube 1 of the present invention. In this embodiment, the siphon tube 1 has its lower end portion closed with a closure or cap 4. At least one opening is formed in a circumferential surface of the siphon tube 1 in a position adjacent to an upper surface of the cap 4 to serve as the liquid-inlet opening 3. In this embodiment, the reason why a lower end of the liquid-inlet opening 3 is disposed adjacent to the closure or cap 4 is that: when the lower end of the liquid-inlet opening 3 is spaced apart from the cap 4 so as to be positioned above the cap 4, a deposit space portion is formed-between the lower end of the liquid-inlet opening 3 and an upper surface of the cap 4 to receive the slurries in such a deposit space portion of the reservoir.

In any one of the above embodiments of the present invention, the liquid-inlet opening 3 through which the liquid contained in the reservoir flows into the siphon tube 1 is slightly spaced apart from the bottom of the reservoir (by a thickness of a circumferential wall of the end portion 2) and directed normal to the longitudinal axis of the siphon tube 1. Due to this, in the siphon tube 1 of the present invention, there is substantially no fear that the slurries having been deposited on the bottom of the reservoir are sucked by the siphon tube 1 through the liquid-inlet opening 3.

Finally, the present application claims the Convention Priority based on Japanese Patent Application No. 2001-283565 filed on Sep. 18, 2001, which is herein incorporated by reference.

What is claimed is:

1. A siphon tube of a connector for a reservoir, said siphon tube is a siphon tube with said connector, which is supported by the connector mounted on a lid of the reservoir containing a liquid material such as an industrial chemical agent used in a semiconductor fabrication process that generates a slurry at the bottom of the reservoir, and reaches the bottom of said reservoir to draw the liquid in said reservoir out of said reservoir, wherein said siphon tube has a tip end portion provided with a liquid-inlet opening which is opened in a lateral direction to the longitudinal axis of the reservoir and has a bottom wall having a thickness between the bottom of the reservoir and the liquid-inlet opening greater than a depth of the slurry so as to avoid sucking in said slurry at the bottom of said reservoir.

2. The siphon tube of the connector adapted to be mounted on the reservoir as set forth in claim 1, wherein: said lower end portion of said siphon tube assumes an inverted T-shaped form provided with opposite end openings in opposite ends of a laterally extending portion of said inverted T-shaped form; said opposite end openings are directed normal to said longitudinal axis of said siphon tube; and, each of said opposite end openings of said siphon tube forms said liquid-inlet opening.

3. The siphon tube of the connector adapted to be mounted on the reservoir as set forth in claim 1, wherein: said lower end portion of said siphon tube is bent in a direction normal to said longitudinal axis of said siphon tube to form a laterally extending portion; a front end portion of said laterally extending portion of said siphon tube is provided with a front end opening directed normal to said longitudinal axis of said siphon tube; and, said front end opening of said laterally extending portion of said siphon tube forms said liquid-inlet opening.

4. The siphon tube of the connector adapted to be mounted on the reservoir as set forth in claim 1, wherein: said lower end portion of said siphon tube is closed with a cap; and, at lease one opening is formed in a circumferential surface of said siphon tube in a manner such that said opening is disposed adjacent to an upper surface of said cap and serves as said liquid-inlet opening.

5. The siphon tube of the connector adapted to be mounted on the reservoir as set forth in claim 1, wherein: said tip end portion is formed integrally as a unit with the siphon tube.

6. The siphon tube of the connector adapted to be mounted on the reservoir as set forth in claim 1, wherein: the bottom wall of the tip end portion is flat and abuts the bottom of the reservoir.

* * * * *